United States Patent [19]

Obermeyer et al.

[11] Patent Number: 5,018,772

[45] Date of Patent: May 28, 1991

[54] LATCHING DEVICE FOR SECURING A CLOSURE TO A CASK FOR TRANSPORTING RADIOACTIVE WASTE

[75] Inventors: Franklin D. Obermeyer; Richard R. Cruz; George Bieberbach, all of Pensacola, Fla.

[73] Assignee: Westinghouse Electric Corp., Pittsburgh, Pa.

[21] Appl. No.: 352,426

[22] Filed: May 16, 1989

[51] Int. Cl.[5] ..... E05C 9/06

[52] U.S. Cl. ..... 292/39; 292/256.67

[58] Field of Search ..... 292/43, 256.67, 36, 292/39, 155; 220/46

[56] References Cited

U.S. PATENT DOCUMENTS

| | | | |
|---|---|---|---|
| 191,699 | 6/1877 | McClellan et al. | 292/39 |
| 826,607 | 7/1906 | Price | 292/39 X |
| 1,929,341 | 10/1933 | Wegner | 292/36 X |
| 2,196,895 | 4/1940 | Bowman | 292/155 X |
| 3,334,937 | 8/1967 | Jofeh | 292/256.67 |
| 4,519,519 | 5/1985 | Meuschke et al. | 220/211 |
| 4,743,054 | 5/1988 | Lavalerie | 292/256.67 |

*Primary Examiner*—Richard E. Moore

[57] ABSTRACT

A closing device for removably securing and sealing engaging a closure around an opening in a transportation cask for radioactive materials is disclosed herein. The closing device comprises a plurality of shear key assemblies uniformly spaced around the outer portion of the closure, each of which includes a shear key having an elongated bolt portion movably mounted in the closure, as well as a latch portion connected to one end of the bolt portion that is insertable into and retractable out of a slot located in the edge of the cask that defines the cask opening. The latch portion is beveled so as to wedgingly engage the slot when inserted therein in order to apply a sealing pressure around the outer edge of the closure. The width of the latch portion of the key is substantially larger than the bolt portion, thereby giving the shear key a T-shaped profile. The broad width of the bolt portion allows the shear key to more uniformly distribute a sealing pressure around the closure. The closing device also includes either a single or multiple drive mechanisms for forcing the latch portions of the shear keys into and out of the slots in the cask. The single drive mechanism is extremely rapid in operation and advantageously applies the same amount of closing force to each shear key simultaneously, while the use of multiple drive mechanisms affords more uniform sealing pressure around the closure edge and more effective radiation shielding properties to the closure.

40 Claims, 9 Drawing Sheets

LATCHING DEVICE FOR SECURING A CLOSURE TO A CASK FOR TRANSPORTING RADIOACTIVE WASTE

BACKGROUND OF THE INVENTION

This invention generally relates to latching devices, and is specifically concerned with a latching device for securing and sealingly engaging a closure around an opening in a cask used for transporting radioactive materials.

Devices for securing closures over the opening in a cask used for transporting radioactive materials are known in the prior art. In one of the most common prior art designs, a circular, lid-type closure is provided with thirty-six uniformly spaced bolt holes around its outer edge. These bolt holes are in turn registrable with threaded bores present in a ledge provided around a wall that circumscribes the opening in the cask. An elastomeric or metal O-ring is provided between the ledge and the closure to effect a gas-tight seal when the closure is mounted over the opening in the cask. In operation, the closure is placed over the opening in the cask so that its outer edge seats over the circular ledge and around the O-ring. The closure is then rotated so that the bolt holes around its outer edge are positioned into registry with the threaded bores present in the ledge. Stainless steel bolts are next inserted in opposing pairs of the bolt holes in the closure, and both bolts of each pair are simultaneously wrung up with a torque wrench until a desired compression between the closure and the ledge is achieved. The simultaneous wringing up of opposing bolts serves to uniformly compress the O-ring sandwiched between the closure and the ledge of the cask which in turn helps to form a uniform sealing engagement between the O-ring, the closure and the upper edge of the cask. Since Nuclear Regulatory Commission (NRC) regulations require such transportation casks to successfully contain radioactive gases and inert gas such as helium which may be under pressure, the total amount of compressive load that the bolts must apply between the closure and the ledge of the cask is on the order of about 500,000 lbsf. (or about $2.224 \times 10^6$ nt). Consequently, the amount of torque which must be applied to each of the thirty-six bolts is considerable. Because these same NRC regulations require the closure to maintain its integrity with the cask upon falling a height of nine meters onto a hard surface, it is easy to see that the tensile and shear load requirements for each of the thirty-six bolts is considerable.

While bolt-type closing devices are capable of fulfilling the criteria set forth by the aforementioned NRC regulations, the applicant has observed a number of areas in the design of such prior art devices where improvement would be desirable. For example, the simultaneous application of large torque forces to eighteen pairs of opposing bolts takes a considerable amount of time, which in turn results in the exposure of the cask handlers to significant amounts of potentially harmful radiation. Still another deficiency in this design is the difficulty by which repairs are made in the event that one of more of the threaded bores in the cask becomes stripped through wear. When such stripping occurs, it may be necessary to re-drill the stripped bores and re-tap them so that they can accept a bolt having threads of larger outside diameter. Unfortunately, such a repair will mean that the closure can fit over the cask in only one specific angular position, i.e., the position where the larger bolt in the closure is in registry with the larger bolt hole. Of course, this "single orientation" problem could be remedied by merely reaming out all of the bolt holes and replacing all of the bolts with bolts having larger outside threads. But, such a repair effort would be time consuming and relatively costly. A third deficiency is the fact that, despite the use of large diameter bolts, these bolts still constitute the weakest part of such transportation casks. Hence, if the cask is subjected to the type of severe mechanical stresses that can be expected under accident conditions, the most likely area of failure is precisely the one that could cause the most damage—the area of attachment between the closure and the cask.

To overcome these deficiencies, it has been proposed that bolt-type closing devices be replaced with a "bank-door" hatch-type cover such as that disclosed and claimed in U.S. Pat. No. 4,519,519 by Robert E. Meuschke assigned to the Westinghouse Electric Corporation. In this device, a plurality of radially movable latches secure the hatch cover in place when a centrally disposed handwheel is rotated. Such a closing device is far faster to operate since the latches that it uses are all simultaneously extended or retracted by the rotation of a single handwheel. The design of this type of closing device is not, however, readily adaptable to a closure for a cask for transporting radioactive materials, since the various latches and their associated linkages are mounted on an exterior wall of the hatch, where they would be exposed to mechanical shock and possible breakage if the cask were dropped. Of course, a design could be envisioned wherein the latches and their linkages could be installed in the interior of a lid-type closure. But such a design would require the provision of slots and other cavities within the closure which would reduce the radiation shielding effectiveness of the closure. Still another difficulty in adapting such a design to a transportation cask is the fact that the centrally-disposed handwheel mechanism does not quite apply the same extension force to all of the latch elements simultaneously, or even symmetrically. This characteristic of "bank-door" type designs normally causes no problems in applications where the only purpose of the closing device is to lock a closure over an opening. But in applications where the closing device must also uniformly and sealingly engage a closure around the edge of an opening by applying a 500,000 lb. compressive load therebetween, such a non-symmetrical loading of the closure could interfere with the effectiveness of the metallic or elastomeric O-ring in sealing pressurized gases in the interior of the cask from the ambient atmosphere.

Clearly, there is a need for a device for removably securing and sealingly engaging a closure around an opening in a cask for transporting radioactive wastes that is faster to operate than prior art closing devices. Ideally, such a closing device should not interfere with the shielding effectiveness of the door, and should be able to withstand the nine meter drop requirements set forth in NRC regulations without any chance of breakage or rupture. Such a closing device should have parts which are easily and individually replaceable in the event of wear so that large portions of the entire cask need not be remachined during its service life. Finally, the closing device should be capable of applying uniform or at least symmetrical pressure around the closure during the closing operation to insure the effectiveness of the O-ring seal.

SUMMARY OF THE INVENTION

Generally speaking, the invention is a latching device for removably securing and sealingly engaging a closure around an opening in a cask for transporting toxic materials, such as radioactive wastes, that overcomes the deficiencies of the prior art. The latching device comprises at least three shear key assemblies uniformly spaced around the outer portion of the closure, each of which includes a shear key having a bolt portion movably mounted in the closure, and a latch portion that is insertable into and retractable out of a slot present in the edge of the cask. The latch portion is beveled so that it wedgingly engages the slot when inserted therein and forcibly depresses the outer edge of the closure against the edge of the cask. The width of the latch portion is made substantially larger than the width of the bolt portion for two reasons. First, the provision of such a wide latch portion more widely distributes the pressure that the shear key applies around the perimeter of the closure when the beveled end of the latch portion is forcibly inserted into the slot. Second, the relatively wide geometry of the latch portion minimizes the local pressure that the beveled end of the latch portion applies to the slot in the cask edge, thereby reducing the bearing forces between the latch portion and the slot which in turn reduces the chance that the latch portion will become frictionally "locked" within its respective slot.

In the preferred embodiment, the combined width of the latch portions of all of the shear keys of the closing device is at least equal to 30 percent of the perimeter of the closure, and may be as high as 90 percent. Additionally, each shear key is preferably T-shaped, wherein the stem and head of the T form the bolt portion and the latch portion of the shear key, respectively. Each of the ends of the latch portions is beveled at an angle shallow enough so that the combined sealing load applied by the latch portions of all the shear keys is at least $2\times10^6$ nt. However, this bevel angle should not be so shallow that the beveled portions of the latch portions self-lock when the latch portions are inserted completely within the slot as a result of frictional forces. When the length of the latch portion is between eight and twelve centimeters, the applicant has found that a bevel angle of between about 10 and 20 degrees, and preferably 15 degrees, is great enough to apply the necessary sealing pressures to the closure without causing the latch portions of the shear keys to self-lock within their respective slots in the cask edge.

To further reduce the chance that any such self-locking will occur, the latch portion of each of shear keys is preferably formed from a galling-resistant material, such as Nitronic 60 ®stainless steel or chrome-plated stainless steel.

The closing device may include either a single drive mechanism or multiple drive mechanisms for applying both a closing and an opening force to the bolt portion of each of the keys within each of the shear key assemblies. The single drive mechanism advantageously applies an equal amount of closing force to the bolt portions of each of the shear keys simultaneously, and may include a collar centrally located with respect to the closure, three toggle linkages, each of which is connected between the bolt portion of one of the shear keys and the collar, and a driver for moving the collar. The driver is preferably in the form of a ball nut threadedly engaged to the closure that moves the collar toward and away from the closure so that the linkages apply both closing and opening forces to the bolt portions of the shear keys. In the preferred embodiment, the collar is compliantly mounted to the ball nut in the direction transverse to the movement of the ball nut so that the collar will move transversely in response to the reactive forces applied to it by the toggle linkages. This feature, coupled with the fact that there are only three such toggle linkages uniformly spaced around the collar, results in a drive mechanism that is "self-centering," and which applies an equal amount of closing force to each bolt portion of each shear key when the ball nut driVer is screwed into the closure. To reduce the chance of breakage in the event that the cask is dropped or otherwise subjected to mechanical shock, all of the components of the single drive mechanism and of the three shear key assemblies are preferably contained within slots and other cavities provided within the closure. The closure may include an additional layer of shielding material, such as lead, to compensate for the radiation shielding losses associated with such slots and cavities. Instead of a single drive mechanism, the latching device may include a plurality of drive mechanisms, each of which is connected to the bolt portion of one of the shear keys of the shear key assemblies. In this embodiment, both the shear key assemblies and their associated drive mechanisms are mounted on the outer half of the radius of the closure in order to minimize any shielding losses which may occur from the installation of cavities or slots within the central portion of the closure. When multiple drive mechanisms are used, each of the drive mechanisms may utilize either cams or lead screws to apply opening and closing forces to the bolt portions of their respective shear keys.

When cams are used, each of the drive mechanisms preferably includes first and second cam blocks for applying a closing and an opening force, respectively, onto the bolt portion of its respective shear key. Each of the cam blocks includes a beveled surface that engages a surface of the bolt portion to apply either a closing or an opening force thereto. Each of the cam blocks may be moved into and out of the closure by means of a bolt. In operation, one of the cam block bolts is moved into the closure while the other cam block bolt is moved out of the closure to apply a net closing or opening force to the bolt portion of the shear key.

When lead screws are used, each of the drive mechanisms preferably includes a lead screw that is threadedly engaged to a bore that extends along the longitudinal axis of the bolt portion for applying both a closing and an opening force to the shear key, depending upon the direction of rotation of the lead screw. A drive train is also provided for applying torque to the lead screw to rotate it. The drive train may include first and second miter gears, the output of the first gear being coupled to the lead screw, and the input of the second gear including a socket for receiving the head of a wrench.

While the single drive mechanism embodiment of the latching device is capable of securing and sealingly engaging a closure to a transportation cask in an extremely short period of time, the use of separate drive mechanisms for each of the shear key assemblies, whether they utilize cams or lead screws, provides a more uniform distribution of the sealing pressure that the closing device applies between the closure and the cask, as well as better overall radiation shielding efficiencies.

BRIEF DESCRIPTION OF THE SEVERAL FIGURES

DETAILED DESCRIPTION OF THE PREFERRED EMBODIMENTS

Figure 1B:
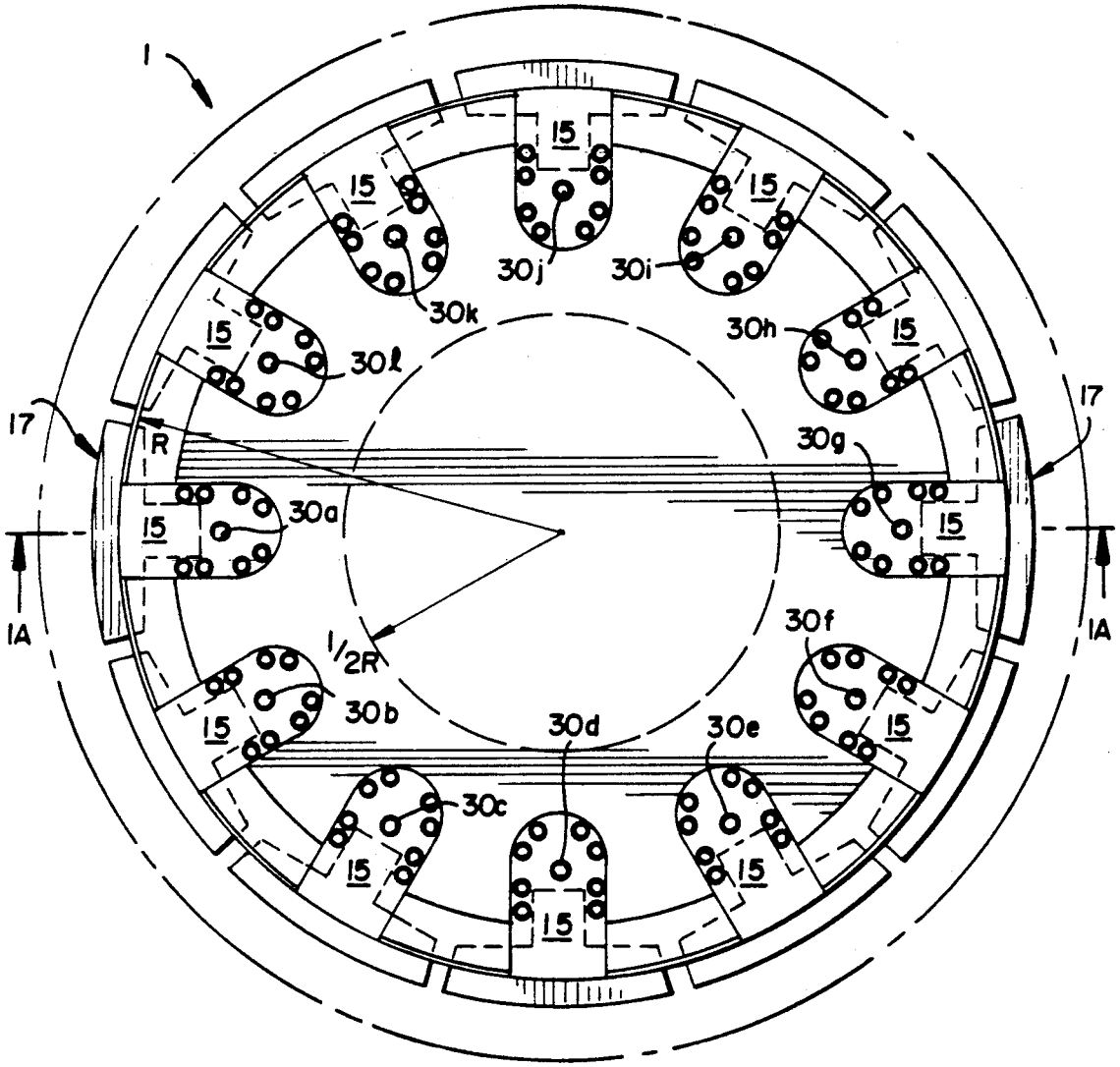
FIG. 1B is a plan view of the closure illustrated in FIG. 1A.
Figure 1A:
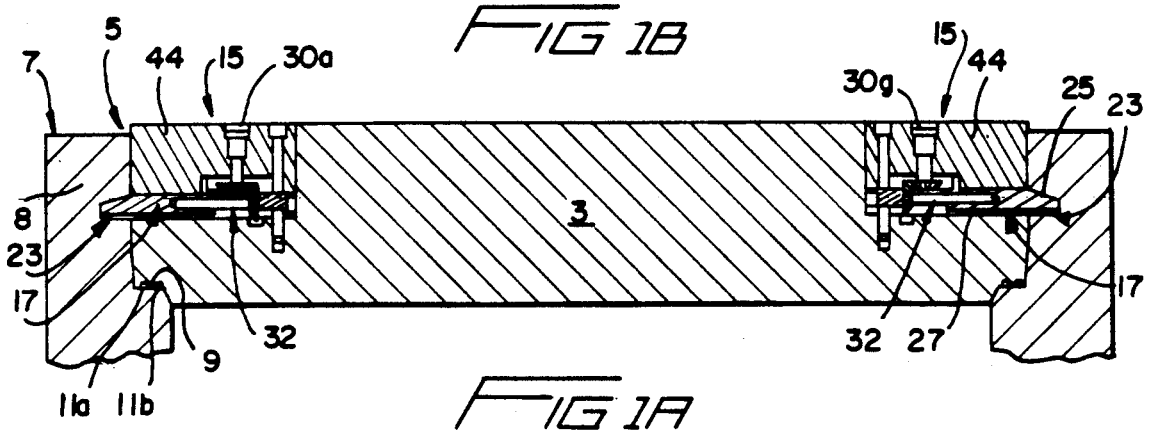
FIG. 1A is a cross-sectional side view of a closure disposed over the opening in a cask and secured thereto by one of the latching devices of the invention.

With reference now to FIGS. 1B and 1A, wherein like numerals designate like components throughout all the several figures, the latching device 1 of the invention is particularly useful in securing a lid-type closure 3 around the opening 5 of a cask 7 for transporting radioactive materials, such as spent fuel rods. Such a transportation cask 7 is generally cylindrical in shape, terminating in a circular wall 8 at one of its ends which defines the opening 5. This wall 8 is typically recessed in order to form an annular ledge 9 upon which the closure 3 seats when the cask 7 is closed. A pair of either metallic or elastomeric O-rings 11*a*, 11*b* is disposed between the ledge 9 and the outer edge of the closure 3 to effect a gas-tight seal when the closure 3 is secured to the cask 7. These O-rings 11*a*, 11*b* are typically retained in annular grooves 13 disposed around the outer edge of the closure 3. Because NRC regulations require the cask 7 to be able to successfully contain radioactive gases and an inert atmosphere such as helium gas, the latching device 1 must be capable of adequately compressing the O-rings 11*a*, 11*b* against the ledge 9 to effect such a gas-tight seal. In actual practice, the applicant has determined that the latching device 1 must apply approximately 500,000 lbsf. (or about $2.224\times10^6$ nt.) in order to create a seal of the required tightness.

With reference now to FIGS. 1A, 1B, 2A and 2B, each of the embodiments of the latching device 1 of the invention includes a plurality of shear key assemblies 15. Each shear key assembly 15 in turn includes a T-shaped shear key 17 having a bolt portion 19 and a latch portion 21 corresponding to the stem and the head of the "T," respectively. The bolt portion 19 of each shear key 17 is slidably mounted within the closure 3, while the latch portion 21 includes a beveled end 22 that is insertable into a slot 23 in the wall 8 of the cask 7. In all of the preferred embodiments, the slot 23 is substantially complementary in shape to the beveled end 22 of the latch portion 21 of its respective shear key 17, and includes a beveled engagement surface 25 which wedgingly engages the beveled end 22 when a closing force is applied along the longitudinal axis of the bolt portion 19 to move the shear key 17 radially. Each shear key 17 is further provided with a drain passageway 27 which allows any water which has collected within the latching device 1 to be drained off. This is an important feature, as such transportation casks 7 are typically emersed in water when they are being either loaded or unloaded with nuclear waste.

Figure 2A:
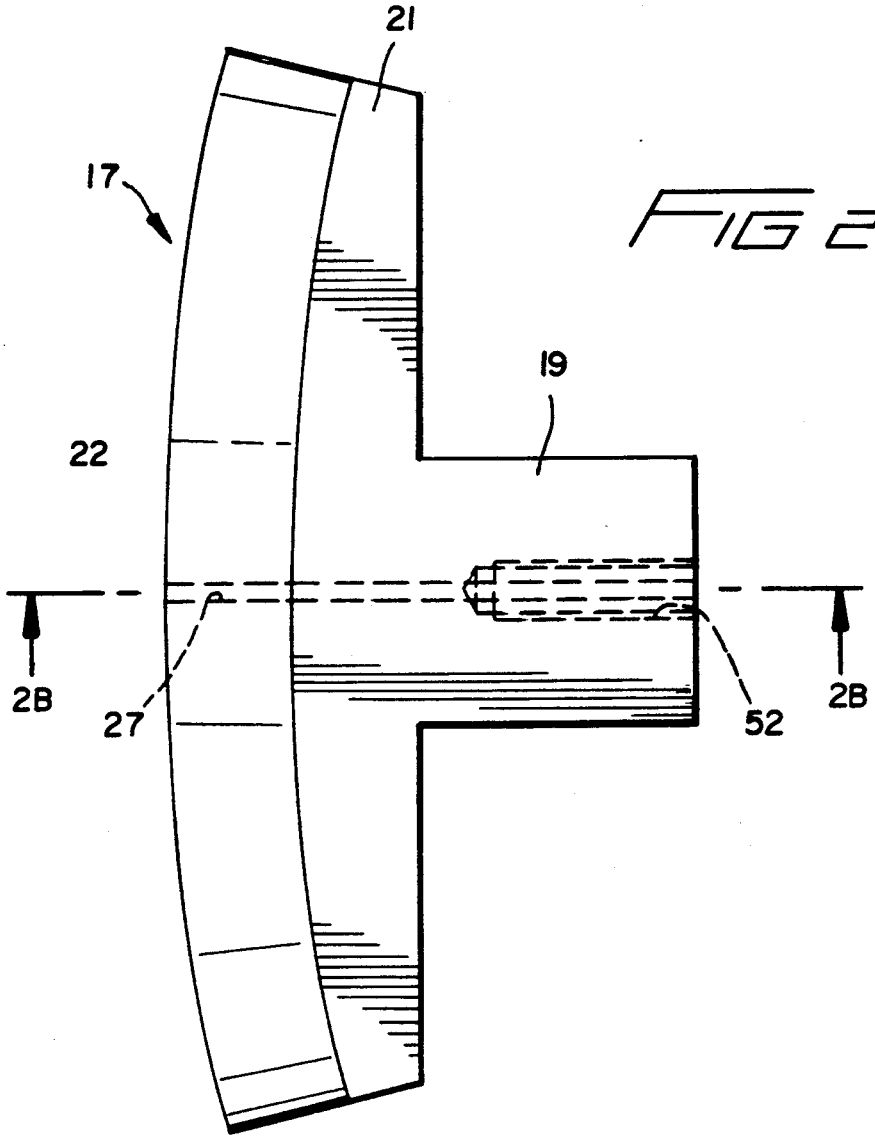
FIG. 2A is a plan view of a shear key within one of the shear key assemblies of the invention.
Figure 2B:
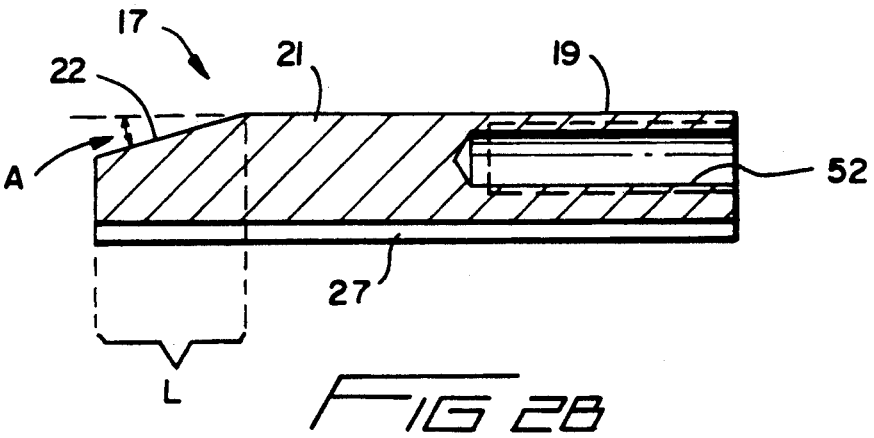
FIG. 2B is a cross-sectional side view of the shear key illustrated in FIG. 2A along the line 2B–B.

With specific reference now to FIG. 2B, the beveled end 22 of the latch portion 21 of shear key 17 is preferably beveled at an angle A of approximately 15 degrees with respect to the horizontal. The overall length L of the latch portion 21 is about 2.1 inches (5.33 centimeters). A shear key 17 having a latch portion 21 so dimensioned would be capable of applying the requisite compressive load betWeen the closure 3 and the ledge 9 of the cask 7 upon which it seats as a result of the wedging engagement between its beveled end 22 and the slot 23. Moreover, the 15 degree bevel angle of the latch portion 21 allows the shear key 17 to provide the required compressive load with the application of only a moderate amount of closing force along the longitudinal axis of the bolt portion 19 without causing the latch portion 21 to become frictionally "locked" into engagement with the beveled engagement surface 25 slot 23 after insertion therein. If the angle A is made substantially made greater than 15 degrees, the length of latch portion 21 that must be inserted into slot 23 to provide the required compressive load could be made shorter; however, the amount of closing force that must be applied along the bolt portion 19 to achieve the desired compressive load between the closure 3 and the circular wall 8 of the cask 7 would be correspondingly greater. The requirement for a correspondingly high closing force is not desirable, as it increases the load on whatever type of drive mechanism is used to forcefully insert the beveled end 22 of the latch portion 21 into the slot 23. On the other hand, while the use of a bevel angle substantially less than 15 degrees on the beveled end 22 would substantially reduce the amount of closing force that must be applied with the shear key 17 to insert the beveled end 22 into the slot 23, (and hence reduce the load on the drive mechanism that supplies such a force , a correspondingly greater length of latch portion 21 would have to be inserted into the slot 23. Such long slot lengths are not desirable, as they could jeopardize the strength of the cask 7. Additionally, the near-orthogonal engagement between the beveled engagement surface 25 of the slot 23 and the beveled end 22 of the shear key 17 could create frictional forces between these components that would necessitate the application of a very large withdrawal force onto the shear key 17 when the operator desires to pull the latch portion 21 from the slot 23. As there is a significant amount of orthogonal compressive force between these two surfaces even when a beveled angle of 15 degrees is used in the beveled end 22, the latch portion 21 of the shear key 17 is preferably formed from an anti-galling material such an Nitronic 60®to prevent it from galling against the surface 25 of slot 23.

Figure 4A:
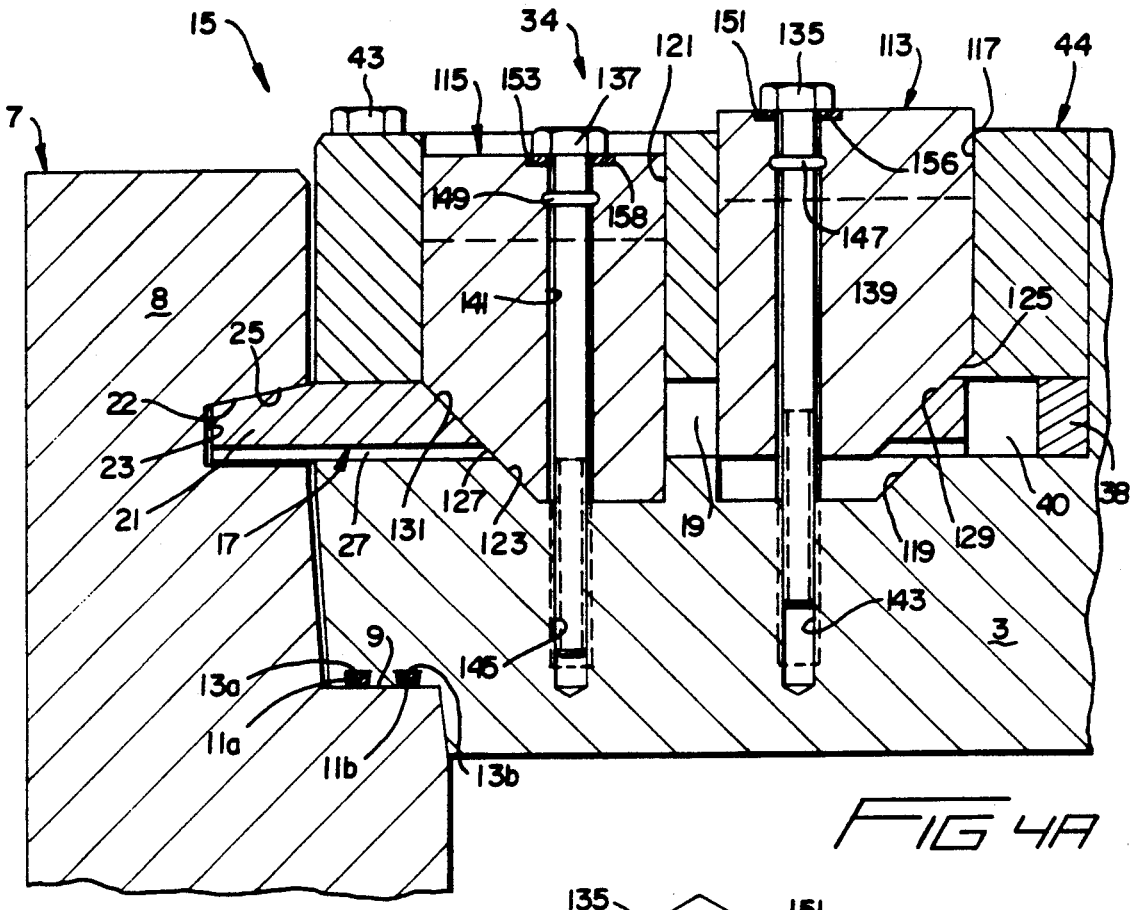
FIG. 4A is a cross-sectional side view of a cam operated shear key assembly of another embodiment of the latching device of the invention.
Figure 4B:
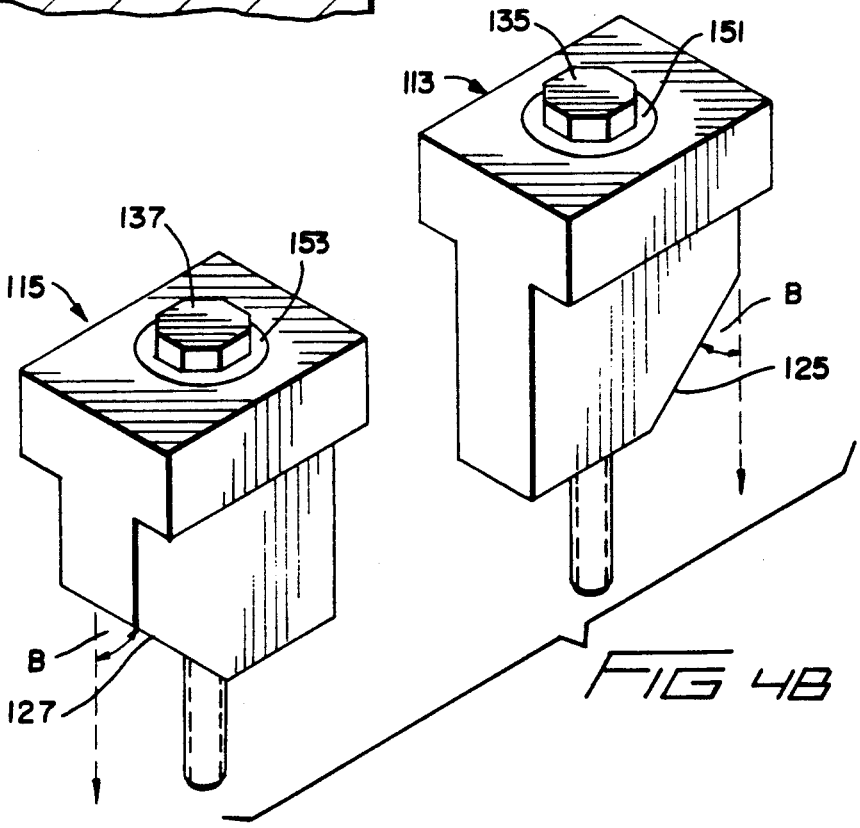
FIG. 4B is a perspective view of the cam blocks which are used to operate the shear key assembly illustrated in FIG. 4A.
Figure 4C:
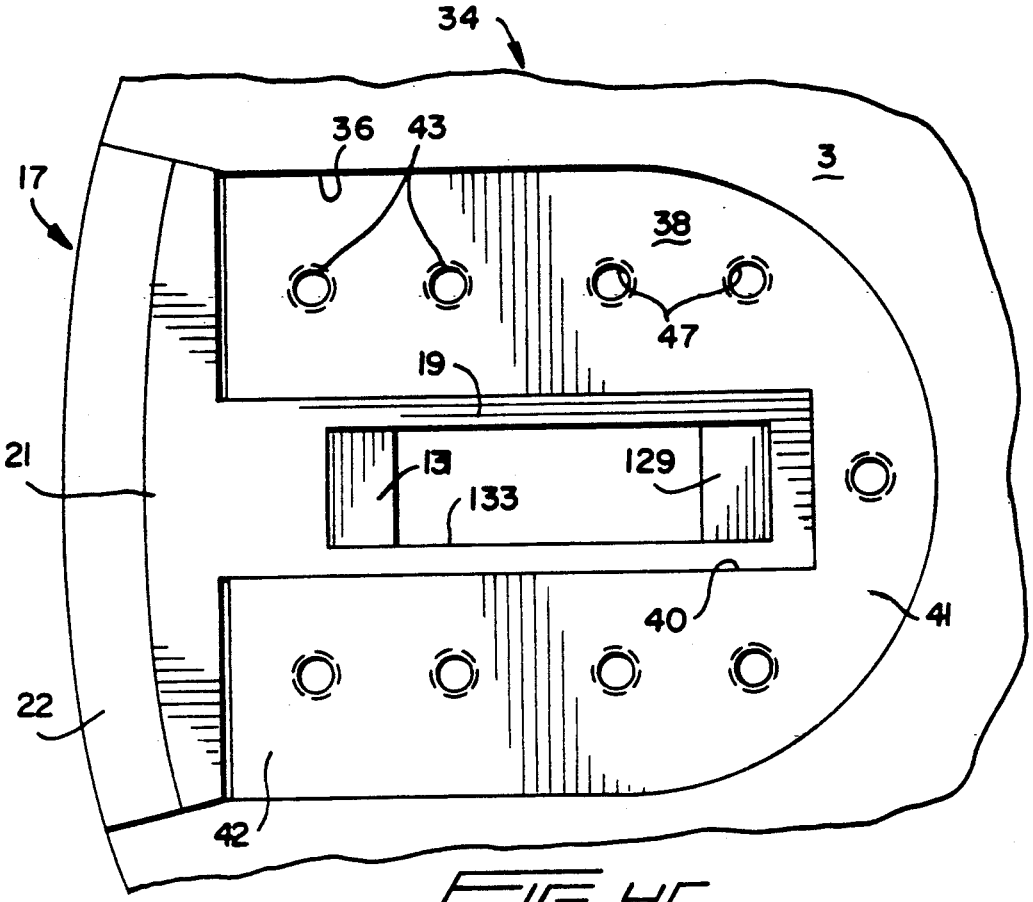
FIG. 4C is a plan view of the cam operated shear key assembly illustrated in FIG. 4A with both the mounting block and cam blocks removed.
Figure 4D:
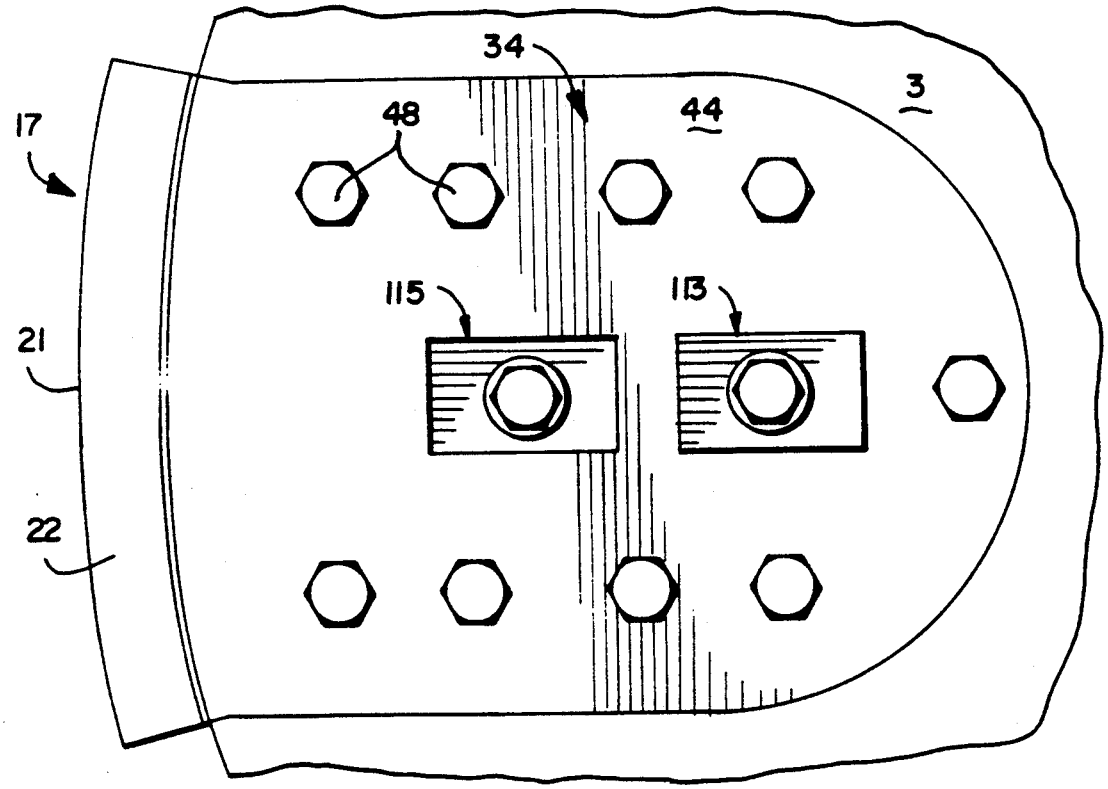
FIG. 4D is a plan view of the shear key assembly illustrated in 4A with the mounting block and cam blocks installed.
Figure 5A:
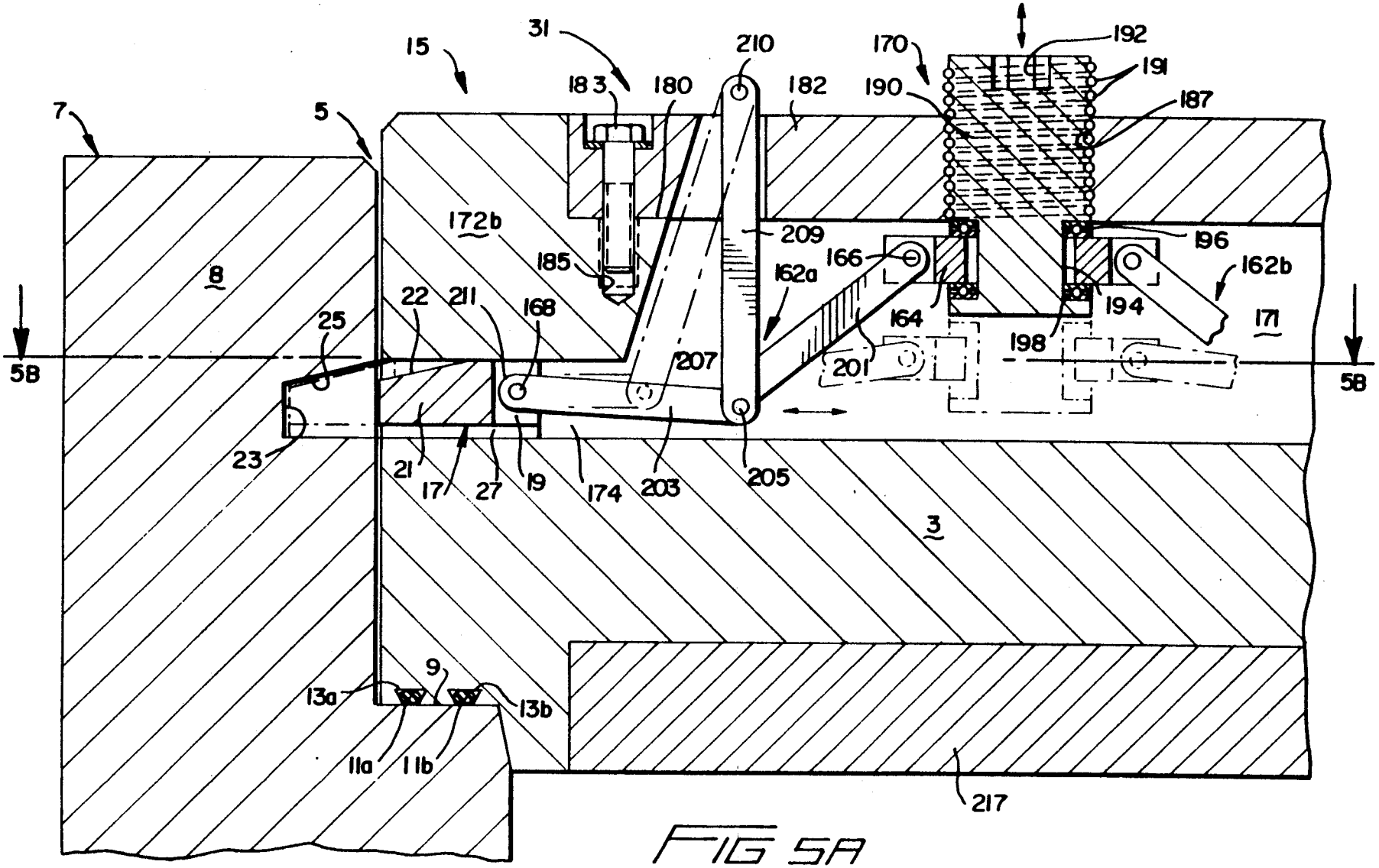
FIG. 5A is a cross-sectional side view of a third embodiment of the latching device of the invention wherein a single drive mechanism is used to extend and retract three shear keys uniformly spaced around the perimeter of the closure.
Figure 5B:
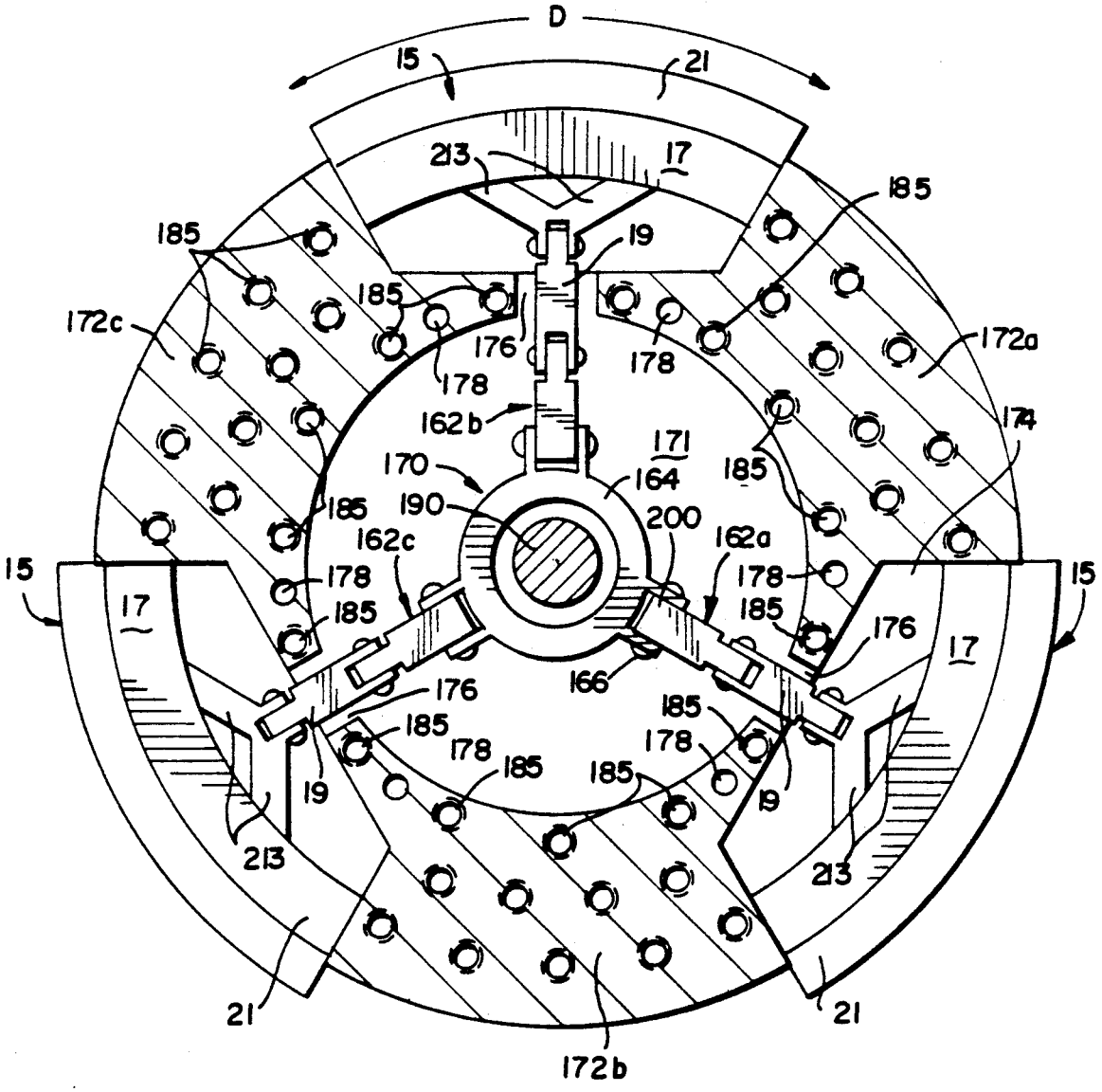
FIG. 5B is a plan view of the latching device illustrated in FIG. 5A along the line 5B—5B.
Figure 5C:
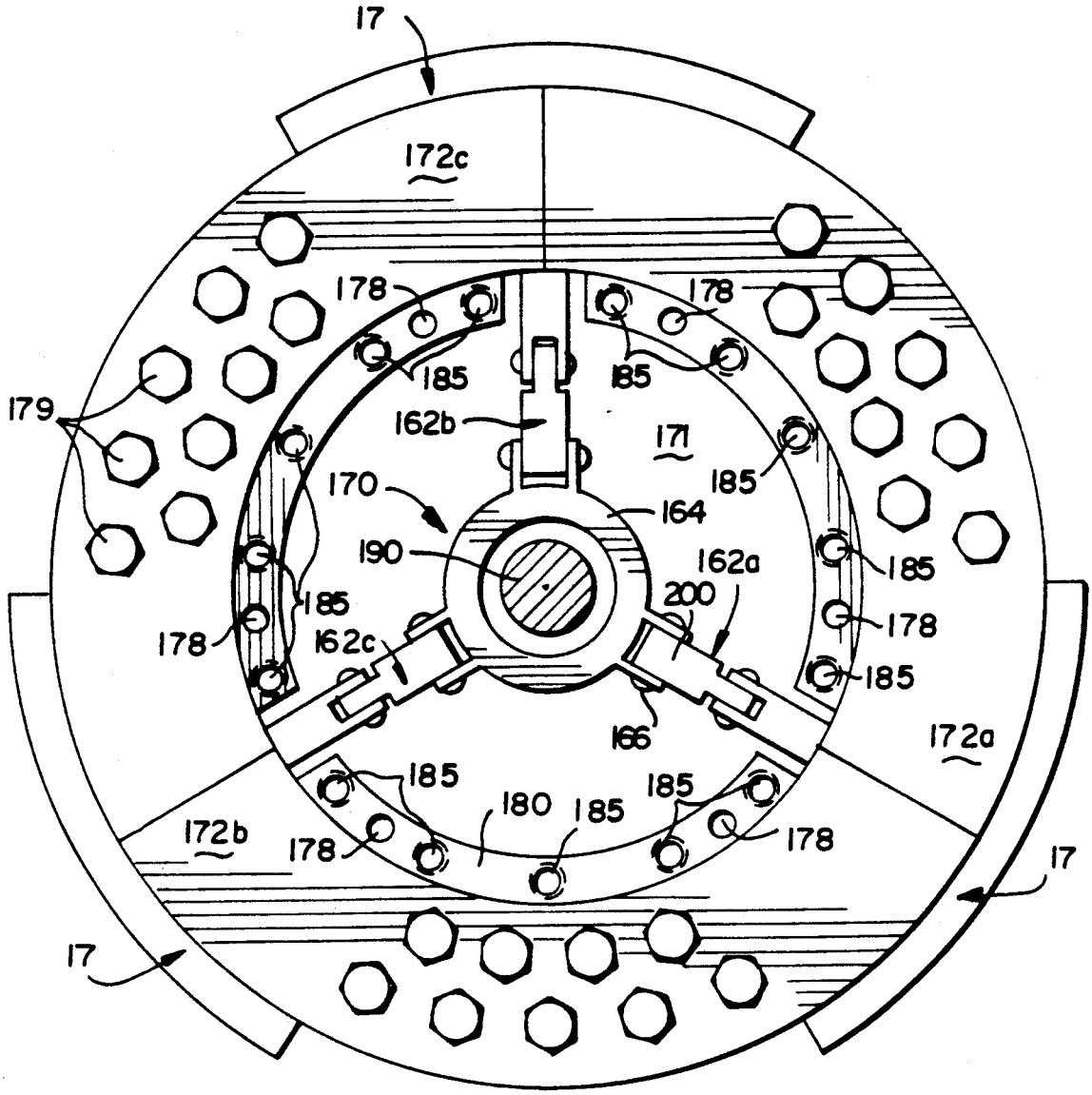
FIG. 5C is a plan view of the latching device illustrated in FIG. 5A with the cover plate removed so that the drive mechanism of the latching device is visible.

The opening and closing forces which must be applied to the shear key 17 of each of the shear key assemblies 15 to insert and withdraw the latch portion 21 of each key 17 from its respective slot 23 may be supplied by either multiple drive mechanisms 30 (such as those illustrated in FIGS. 3A, 3B and 4A, 4B, 4C and 4D), or a single drive mechanism 31 (such as that illustrated in FIGS. 5A, 5B and 5C).

In the preferred embodiments of the invention, the multiple drive mechanisms 30 may each take the form of a lead screw-type drive mechanism 32 (illustrated most clearly in FIGS. 3A and 3B), or a cam block-type mechanism 34 (illustrated in FIGS. 4A through 4D). Both the lead screw-type and ca block-type drive mechanisms 32 and 34 are installed within a U-shaped slot 36 located on the outer half of the radius R of the closure 3 (as may best be seen in FIG. 1A). In both of these drive mechanisms 31 and 32, a U-shaped spacing block 38 is seated within one of the U-shaped slots 36 located around the outer edge of the closure 3. These spacing blocks 38 include a centrally disposed slot 40 for both receiving and slidably mounting the bolt portion 19 of a shear key 17. The spacing block 38 is preferably formed from a solid block of number 304 stainless steel, and includes a rounded heel portion 41 disposed toward the center of the closure 3, and a top portion 42 disposed toward the outer edge of the closure 3. A series of uniformly spaced bolt holes 43 are provided in each spacing block 38 register with threaded bores 44.5 present in the closure 3 when the heel portion 41 of the spacing block 38 is positioned within the U-shaped slot 36 as shown. Overlying the U-shaped spacing block 38 in each of the multiple drive mechanisms 30 is a mounting block 44 Which serves to securely mount in respective drive mechanism tightly within the closure 3. To this end, the mounting block 44 includes a pattern of bolt holes 46 which are registrable with the bolt holes 43 present in the U-shaped spacing block 38. When each of the multiple drive mechanisms 30 is completely assembled, mounting bolts 48 extend through the holes 43 and 46 of the U-shaped spacing block 38, and the mounting block 44, and are screwed down into the bolt holes 44.5 provided in the closure 3 on the floor of the U-shaped slot 36.

Figure 3A:
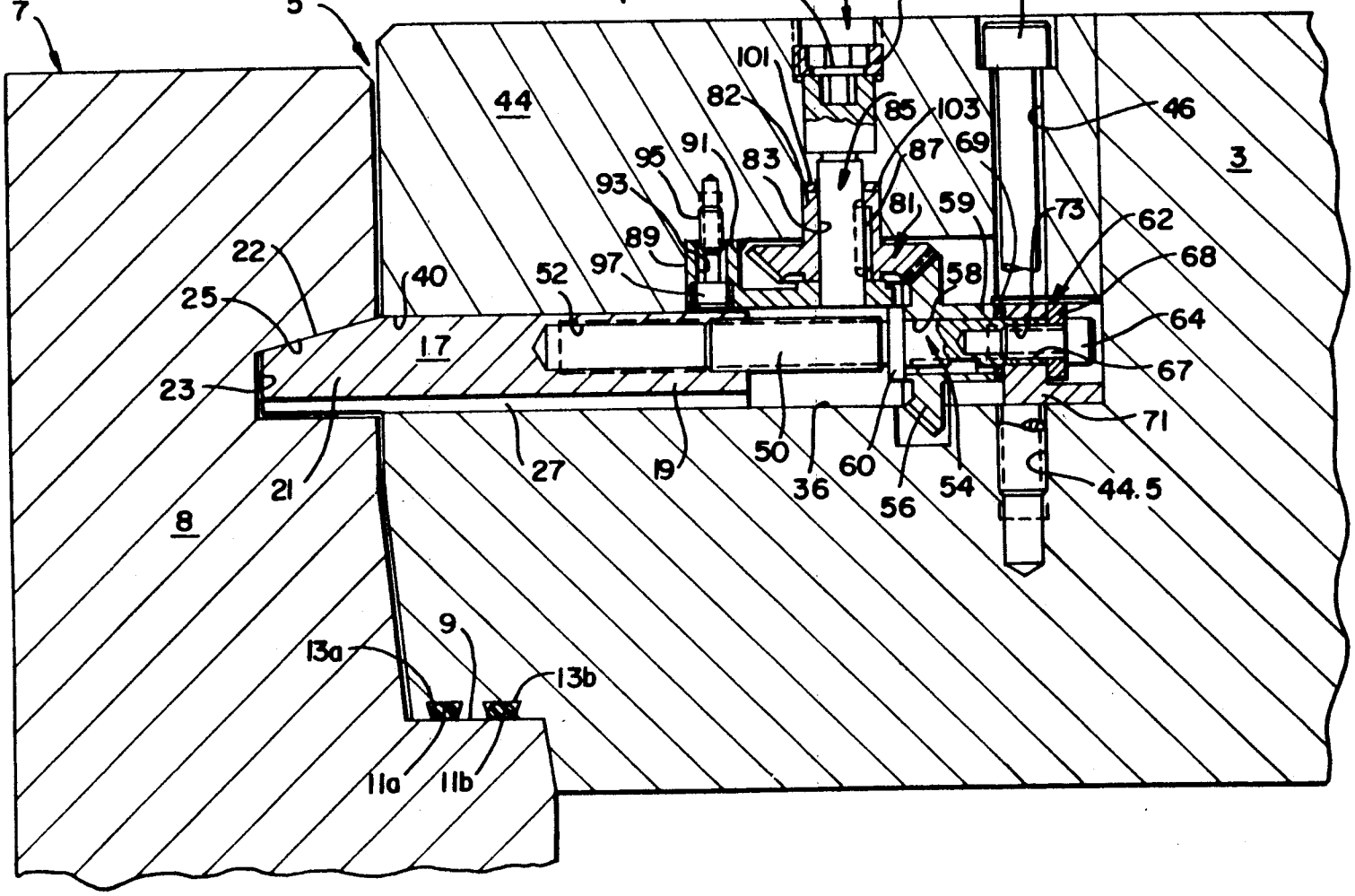
FIG. 3A is an enlarged cross-sectional side view of a gear operated shear key assembly embodiment of the latching device of the invention.
Figure 3B:
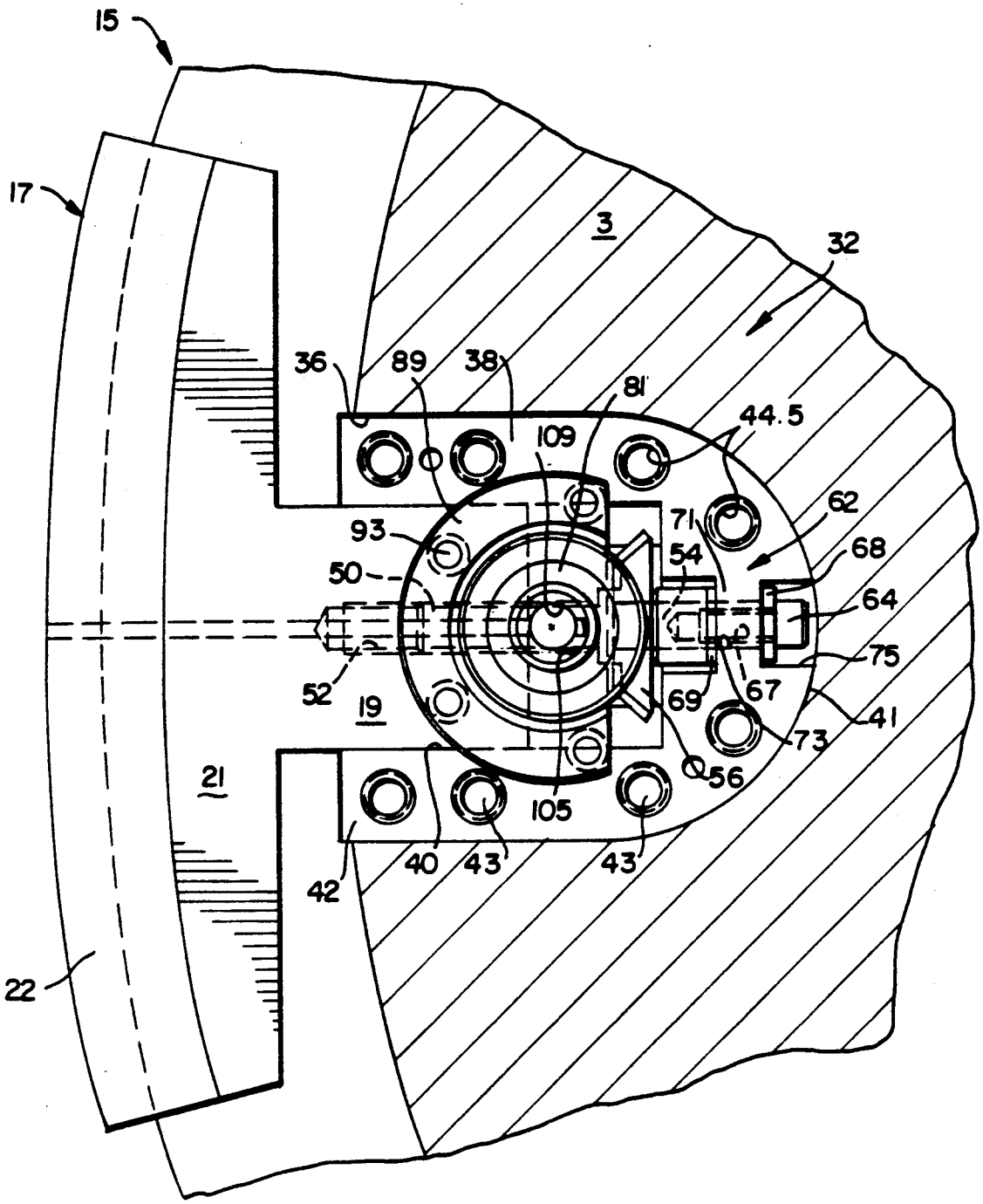
FIG. 3B is a plan view of the gear operated shear key assembly illustrated in FIG. 3A as it would appear with the mounting block removed.

With specific reference now to FIGS. 3A and 3B, each of the lead screw-type drive mechanisms 32 includes a rotatable lead screw 50 threadedly engaged within a bore 52 located along the longitudinal axis of the bolt portion 19 of a shear key 17. In the preferred embodiment, the lead screw 50 has a pitch of approximately 12 threads per inch (or approximately 4.7 threads per centimeter). From the illustration in FIG. 3A, it is evident that the lead screw 50 is capable of extending and retracting the latch portion 21 of the shear key 17 into and out of the slot 23, depending upon whether the lead screw 50 is rotated clockwise or counterclockwise. To this end, lead screw 50 is integrally connected to an output shaft 54 of a vertically oriented bevel gear 56. This output shaft 54 is disposed within a bore 58 that runs through the bevel gear 56 that is concentrically disposed around its axis of rotation. From thence, the output shaft 54 is surrounded by a mounting shank 55 that is integrally connected to a bevel gear 56. Axial movement between the output shaft 54 and the bevel gear 56 is prevented by capturing the bevel gear 56 between an annular shoulder 60 located in the output shaft 54 that abuts the front end of the gear 56, and a gear support assembly 62 which abuts the back end of the gear 56. Relative rotary movement between the vertically oriented bevel gear 56 and the output shaft 54 is prevented by means of a mounting key 63 disposed within mutually aligned radial slots in both the bevel gear 56 and the shaft 54, so that the gear 56 rotates along with the shaft 54. A machine screw 64 is disposed within a threaded bore 67 located at the back end of the output shaft 54. This shaft 54 is prevented from axially moving with respect to the U-shaped spacing block 38 by means of proximal and distal thrust washers 68 and 69 located between the head of the machine screw 64 and a bridging section 71 of the spacing block 38, and the edge of the mounting shank 55 of the bevel gear 56 and bridging section 71, respectively. Because of the high loads applied to these washers 68, 69, they are preferably formed from an anti-galling material such as Nitronic 60®. The back end of the output shaft 54 is rotatably supported by means of a bore 73 located within the bridging section 71. A recess 75 is provided in the heel portion 41 of the spacing block 38 to accommodate the head of the machine screw 64 and the washer 68.

The vertically oriented bevel gear 56 meshes with a horizontally mounted bevel gear 81 which likewise includes a mounting shank 82 and a bore 83 concentrically disposed along its axis of rotation. The bore 83 accommodates an input shaft 85 which is locked from relative movement therewith by means of mounting key 87. A bore 88 rotatably supports the input shaft 85 leading to the horizontally mounted bevel gear 81. The bottom end of the input shaft 85 and the gear 81 that is mounted thereto is fixed in place relative to the mounting block 44 by means of a bearing plate 89. This plate 89 is mounted within a recess 91 in the mounting block 44 by means of bolt holes 93 within the plate 89 that are registrable with threaded bores 95 which in turn receive machine screws 97. At the back end of the horizontally mounted bevel gear 81 at the proximal edge of the mounting shank 82, a thrust washer 101 is disposed. This thrust washer 101 is captured between the mounting shank 82, and an annular shoulder 103 present within the bore 88 in the mounting block 44. The top end of the input shaft 85 includes an enlarged portion 105 which in turn is accommodated within an enlarged portion 107 of the bore 88. The top end of the shaft 85 terminates in a hexagonal socket 109 for receiving a hexagonal drive nut (not shown).

In operation, the hexagonal drive nut of a pneumatic wrench is inserted within the socket 109. The resulting torque drives the horizontally mounted bevel gear 81, which in turn transfers this torque to the vertically mounted bevel gear 56 and from thence to the output shaft 54. The rotation of the output shaft 54 in turn causes the lead screw 50 to rotate, thereby applying either an extending or a retracting force along the longitudinal axis of the bolt portion 19 of shear key 17. The thrust washers 68 and 69 transfer the considerable reactive forces applied to the bevel end 22 of the shear key 17 to the bridging section 71 of the U-shaped spacing block 38.

With reference now to FIGS. 4A, 4B, 4C and 4D, the multiple drive mechanisms 30 of the latching device 1 of the invention may also take the form of a cam block type drive mechanism 34. Such a mechanism 34 includes an opening cam block 113 and a closing cam block 115 for applying opening and closing forces to the bolt portion 19 of their respective shear keys 17, respectively. The opening and closing cam blocks 113, 115 are slidably movable within complimentarily shaped recesses 117, 119 and 121, 123 in the mounting block 44 and the closure 3, respectively. Each of these cam blocks 113, 115 further includes a beveled, ramp-like surface 125, 127 for engaging ramp surfaces 129 and 131 disposed on either end of an elongated slot 133 disposed along the longitudinal axis of the bolt portion 19 of the shear key 17. In the preferred embodiment, the ramp-like surfaces 125 and 127 are beveled at an angle B of 25 degrees with respect to the vertical axis (as is indicated in FIG. 4B).

Each of the cam blocks 113 and 115 are vertically displaced within their respective recesses 117, 119 and 121, 123 by actuating bolts 135 and 137. Each of these bolts is conducted through its respective cam block 113, 115 through a smooth bore 139, 141, respectively. These bores 139, 141 are in turn registrable with threaded bores 143 and 145 located within the closure 3 as shown. Snap rings 147, 149 prevent the cam blocks 113, 115 from freely moving along the longitudinal axis of their respective actuating bolts 135, 137. As the tensile load between the heads of the actuating bolts 135, 137 can be quite intense against the upper surface of the cam blocks 113, 115 when the shear key 17 is inserted or withdrawn within its respective slot 23, Nitronic® washers 151, 153 are provided around the bolts 135, 137 within circular recesses 156, 158 to prevent galling from occurring between the heads of these bolts 135, 137 and the upper surface of the cam blocks 113, 115.

In operation, when the system operator desires to insert the latch portion 21 of the shear key 17 within the slot 23 of the cask wall, he applies a clockwise torque to actuating bolt 137 while simultaneously applying a counterclockwise torque to actuating bolt 137. This may be done by applying a pair of socket wrenches arranged in parallel to the actuating bolts 135, 137. This, of course, will have the effect of arranging the cam blocks 113, 115 in the position illustrated in FIG. 4A. The 25 degree angle B of the beveled, ramp-like surfaces 125, 127 of the cam blocks 113, 115 provides enough mechanical advantage between the cam blocks 113, 115 and the bolt portion 19 of the shear key 17 to horizontally displace the shear key 17 with torque loads which are readily within the ability of a man to apply manually onto the heads of the bolts 135, 137. Such a mechanical advantage could, of course, be increased by making the angle B shallower with respect to the horizontal. However, such a shallower beveling of the ramp-like surfaces 125, 127 would also increase the vertical length of the stoke of the cam blocks 113, 115 and would further require the use of deeper threaded bores 143, 145. With reference now to FIGS. 5A and 5B, the latching device 1 of the invention may also employ a single drive mechanism 31. Such a drive mechanism 31 includes three toggle linkages 162*a*, 162*b*, 162*c*. Each of these linkages is connected at its proximal end to a self-centering collar 164 by means of a pin 166, and at its distal end to the bolt portion 19 of a shear key 17 having an extra wide latch portion 21 by means of another pin 168. Unlike the previously described multiple drive mechanisms 30, this single driver mechanism includes a driver assembly 170 that is located within a centrally disposed cavity 171 located in the inner half of the radius of the closure 3. This cavity 171 is formed from three arcuate spacer plates 172*a*, 172*b* and 172*c* that are mutually adjoining. Each spacer plate 172*a*, 172*b* and 172*c* includes a cutout portion 174 for accommodating the extra wide latch portion 21 of its respective shear key 15. Each of these cutout portions 174 terminates, at its proximal portion, in a gap 176 for conducting its respective linkage 162*a*, 162*b* and 162*c*. Each of these spacer plates 172*a*, 172*b*, and 172*c* further includes an array of bores 178 which are registrable with threaded bores (not shown) located within the body of the closure 3 itself. With specific reference now to FIG. 5C, these bores 178 receive bolts 179 that in turn secure each of the arcuate spacer plates 172*a*, 172*b* and 172*c* firmly over the closure 3. As is further evident in FIG. 5C, each of the arcuate spacer plates 172*a*, 172*b* and 172*c* includes, around its inner edge, a ledge 180. This ledge receives a circular cover plate 182 (shown in FIG. 5A) that is secured around the ledge 180 by a plurality of bolts 183 which are receivable within threaded bores 185 disposed around the periphery of the ledge 180. Finally, a relatively large threaded opening 187 is provided in the center of the cover plate 182 for a purpose which will become evident directly.

The prime mover of the driver assembly 170 is a ball nut 190 that is threadedly engaged to the opening 187 and which may be screwed either into or out of the plate 182. An exemplary ball nut which may be used in conjunction with the invention is disclosed and claimed in U.S. Pat. No. 3,512,426, the entire disclosure of which is hereby expressly incorporated herein by reference. Such ball nuts substantially reduce the amount of friction between their own threads and the threads of the opening to which they are engaged by providing a plurality of ball bearings 191 that ride in the grooves defined by these threads. The reduction in friction is so complete between the threads of the ball nut and the threads of the opening 187 to which it is engaged that the head of a long-handled hexagonal wrench (not shown) can be inserted into the hexagonal socket 192 of the ball nut 190 and a very large torque applied thereto without any binding or galling occurring between the outer threads of the ball nut 190, and the threads of the opening 187 in the cover plate 182.

An annular recess 194 is provided near the bottom end of the ball nut 190. The previously mentioned, self-centering collar 164 is received within this annular recess 194 and is sandwiched between top and bottom thrust bearing assemblies 196 and 198. This mechanical configuration allows the self-centering collar 164 to "float" in the horizontal direction within the annular recess 194 while at the same time preventing the collar 164 from moving any significant distance along the axis of rotation of the ball nut 190.

With reference again to FIG. 5A, each of the toggle linkages 162*a*, 162*b* and 162*c* includes a proximal bar 201 and a distal bar 203 which is hingedly connected by a pin 205 at lug joint 207. A vertically oriented stabilizer bar 209 is also hingedly connected at its bottom end to the lug joint 207 and pivotally connected at its upper end by pin 210 to the cover plate 182. The distal end of the bar 203 is in turn connected to the bolt portion 19 of the shear key 17 at lug joint 211 by means of the previously mentioned pin 168.

The operation of the single drive mechanism 31 may best be understood with respect to FIG. 5A. When the ball nut 190 is screwed down into the position illustrated in phantom, the proximal bar 201 of toggle linkage 162*a* is pivoted into a more horizontal position, which in turn applies a horizontally-oriented closing force to the bolt portion 19 of the shear key 17 through distal bar 203. As the distal bar 203 is extended toward the outer edge of the closure to insert the beveled end 22 of the latch portion 21 into the slot 23, the stabilizer bar 209 swings into the position shown in phantom it stabilizes and strengthens the movement along the linkage 162*a* friction which would otherwise occur due to sliding of the linkage on the spacer plate 172*b*. When the beveled end 22 of the shear key 17 reaches the position shown in phantom, the closure 3 is secured to the circular wall 8 and compressively engaged around the ledge 9.

While the ball nut 190 is being screwed down through the cover plate 182 and toward the closure 3, the self-centering properties of the collar 164 insure that the latch portions 21 of each of the three shear keys 17 are making substantially identical progress through their respective slots 25. Such an even advance of the shear key 17 results from the fact that the self-centering collar 164 will "float" small distances in the horizontal direction to compensate for any unevenness in the reactive forces applied to the toggle linkages 162*a*, 162*b* and 162*c* from the latch portions 21 of their respective shear keys 17. The self-centering nature of the collar 164 is an important feature, since it allows the beveled ends 22 of the latch portions 21 of each of the shear keys 17 to advance at very nearly the same rate within their respective slots 23, which in turn has the effect of applying uniform compression between the closure 3 and the ledge 9 of the cask wall 8 during the closing operation.

It should be noted that there are three major structural distinctions between a latching device 1 that employs multiple drive mechanisms 30 and a latching device 1 that employs the single drive mechanism 31. First, because the use of a single drive mechanism 31 limits the number of shear keys 17 to three, each of these shear keys 3 includes an exceptionally wide latch portion 21 in order to distribute the compressive forces applied by the shear keys 17 as broadly as possible. Second, because of the extra width of the latch portions 21 used in this type of drive mechanism 31, a fork-type coupling 213 is used between the bolt portion 19, and the latch portion 21 (as may best be seen in FIG. 5B). Third, a lead insert 217 is placed within the bottom of the closure 3 in order to compensate for the loss of radiation shielding caused by the cavity 171 which houses the mechanism 31.

While the embodiment of the latching device 1 that employs the single drive mechanism 31 is the fastest to operate, the embodiment of the device that employs multiple drive mechanisms 30 in the form of either the lead screw type drive mechanism 32 or the cam block-type drive mechanism 34 applies a more uniform compressive force around the perimeter of the closure 3 since more shear keys 17 can be used to cover more of this perimeter.

We claim:

1. A latching device for removably securing and sealingly engaging a closure around an opening in a cask defined by an edge of said cask, comprising:

at least three shear key assemblies uniformly spaced around the outer portion of the closure, each of which includes a shear key means having a bolt portion movably mounted in said closure, and a latch portion that is insertable into and retractable out of a slot means in said cask edge in response to the application of a closing and an opening force applied to said bolt portion, said latch portion being beveled so as to wedgingly engage said slot means when inserted therein and to depress and engage the outer portion of said closure against said cask edge, and at least one drive mechanism located within a cavity in said closure and connected to the bolt portion of said shear key assemblies for applying said closing and opening forces to said bolt portions, wherein the width of said latch portion is substantially larger than the width of said bolt portion to moore widely distribute the pressure that the latch portion applies around the perimeter of the closure when a closing force is applied to said bolt portion, and to minimize the pressure between said latch portion and said slot means to reduce binding forces therebetween.

2. A latching device for removably securing and sealingly engaging a closure around an opening in a cask that is defined by an edge of said cask, comprising:

a plurality of shear key assemblies uniformly spaced around the outer portion of the closure, each of which includes a shear key means having an elongated bolt portion movably mounted in said closure, and a latch portion connected to one end of said bolt portion that is insertable into and retractable out of a slot means in said cask edge in response to a closing and an opening force applied along the longitudinal axis of the bolt portion, said latch portion being beveled so as to wedgingly engage said slot means when inserted therein and to depress the outer edge of said closure into sealing engagement around said cask edge, and at least one drive mechanism located within a cavity in said closure and connected to the bolt portion of said shear key assemblies for applying said closing and opening forces to said bolt portions, wherein the width of said latch portion is substantially larger than the width of the bolt portion to distribute the sealing pressure that said latch portion applies to the edge of the closure over a larger amount of the perimeter of the closure, and to minimize the pressure between said latch portion and said slot means to reduce binding forces therebetween.

3. A latching device as defined in claim 2, wherein the bolt portion of each shear key means is connected to the middle of said latch portion so that each of said shear key means is T-shaped.

4. A latching device as defined in claim 2, wherein the combined width of the latch portions of all of the shear key means is at least equal to 30 percent of the perimeter of the closure.

5. A latching device as defined in claim 2, wherein each of said latch portions includes an end beveled at an angle shallow enough so that the combined sealing load applied by all said latch portions is at least $2\times10^6$ nt. when all of said beveled ends are completely inserted into their respective said slot means, but great enough so that said beveled portions do not self-lock against said slot means when inserted therein.

6. A latching device as defined in claim 2, wherein the end of said latch portion is beveled at an angle of between about 10 and 20 degrees relative to the longitudinal axis of the bolt portion of the shear key means.

7. A latching device as defined in claim 2, wherein the length of the latch portion is between about 4 and 6 cm.

8. A latching device as defined in claim 2, wherein the end of said latch portion is beveled at an angle of between about 12 and 18 degrees relative to the longitudinal axis of the bolt portion, and the length of the latch portion is between about 5 and 5.50 cm.

9. A latching device as defined in claim 5, wherein the material forming the slot means and the latch portion of the shear key means are each formed from Nitronic 60 ®to prevent galling from occuring therebetween.

10. A latching device as defined in claim 5, wherein the material forming the slot means and the latch portion of the shear key means is stainless steel that has been chrome-plated to prevent galling from occurring therebetween.

11. A latching device for removably securing and sealingly engaging a closure around an opening in a cask for transporting radioactive materials, said cask opening being defined by an edge of said cask, comprising:

three shear key assemblies uniformly spaced around the outer portion of the closure, each of which includes a shear key means having an elongated bolt portion movably mounted in said closure, and a latch portion connected to one end of said bolt portion that is insertable into and retractable out of a slot means present in the edge of said cask in response to a closing and an opening force applied along the longitudinal axis of said bolt portion, said latch portion having an end that is beveled so as to wedgingly engage said slot means when inserted therein and to depress the outer edge of said closure into sealing engagement against said cask edge, and a single drive mechanism connected to each of said shear key means and located within a cavity in said closure for simultaneously applying a closing and an opening force to the bolt portion of each, wherein the width of the latch portion of each of said shear key means is substantially larger than the width of the bolt portion to uniformly distribute sealing pressure around the perimeter of the closure, as well as to minimize localized pressure between the latch portion and the slot means to reduce binding forces therebetween.

12. A latching device as defined in claim 11, wherein the combined width of the latch portions of all three of the shear key means is at least equal to 30 percent of the perimeter of the closure.

13. A latching device as defined in claim 11, wherein said single drive mechanism applies an equal amount of closing force to the bolt portions of each of the shear key means.

14. A latching device as defined in claim 13, wherein said single drive mechanism includes a collar means centrally located with respect to the closure, three toggle linkages, each of which is connected between the bolt portion of one of said shear key means and said collar means, and a driver means for moving said collar means toward and away from said closure so that said linkages apply closing and opening forces to said bolt portions.

15. A latching device as defined in claim 14, wherein said driver means is compliantly mounted to the collar means in the direction transverse to the movement of the driver means toward and aWay from said closure so that said collar means will move transversely in response to the reactive forces applied to it by the toggle linkages to apply an equal amount of closing force to each bolt portion of each shear key means.

16. A latching device as defined in claim 14, wherein said driver means includes a ball nut threadedly engaged to said closure.

17. A latching device as defined in claim 16, wherein said collar means is captured between two opposing ball thrust bearings mounted onto the ball nut, said collar means being slidably movable in a direction parallel to the orientation of said bearings to accommodate said compliant movement.

18. A latching device as defined in claim 11, wherein said three shear key assemblies and said single drive mechanism are mounted in cavities present in said closure.

19. A latching device as defined in claim 18, wherein said closure includes a layer of shielding material to compensate for radiation shielding losses associated with said cavities in said closure.

20. A latching device as defined in claim 14, wherein said collar means is formed from a galling resistant metal.

21. A latching device for removably securing and sealingly engaging a closure around an opening in a cask for transporting radioactive materials, said cask opening being defined by an edge of said cask, comprising:

a plurality of shear key assemblies uniformly spaced around the outer portion of the closure, each of which includes a shear key means having an elongated bolt portion movably mounted in said closure, and a latch portion connected to one end of said bolt portion that is insertable into and retractable out of a slot means present in the edge of said cask in response to a closing and an opening force applied along the longitudinal axis of said bolt portion, said latch portion having a beveled end that wedingly engages said slot means when inserted therein and depresses the outer edge of said closure into sealing engagement against said cask edge, and a plurality of drive mechanisms located within a cavity in said closure, each of which is connected to the bolt portion of one of the shear key means to apply a closing and an opening force to said bolt portion, wherein the width of the latch portion of each of said shear key means is substantially larger than the width of the bolt portion to uniformly distribute sealing pressure around said closure and to minimize localized pressure between the latch portion and the slot means to reduce binding forces therebetween.

22. A latching device as defined in claim 21, wherein said shear key assemblies and their associated drive mechanisms are both located around the outer edge of the closure away from the central portion of said closure.

23. A latching device as defined in claim 21, wherein said closure is circular and wherein said shear key assemblies and their associated drive mechanisms are located on the outer half of the radius of the closure.

24. A latching device as defined in claim 23, including twelve shear key assemblies, each of which is driven by a drive mechanism, said shear key assemblies and drive mechanisms being uniformly spaced 30 degrees around the edge of the circular closure.

25. A latching device as defined in claim 21, wherein each of said drive mechanisms includes at least one cam means for applying a closing force on the bolt portion of its respective shear key means.

26. A latching device as defined in claim 21, wherein each of said drive mechanisms include first and second cam means for applying a closing and an opening force respectively on the bolt portion of its respective shear key means.

27. A latching device as defined in claim 25, wherein said cam means is movably mounted in said closure, and includes a beveled surface that engages a surface of the bolt portion to apply a closing force thereto.

28. A latching device as defined in claim 27, wherein said cam means is moved into and out of said closure by a bolt means.

29. A latching device as defined in claim 27, wherein the bolt portion includes a beveled surfaces for engaging the beveled surface of said cam means.

30. A latching device as defined in claim 26, wherein said cam means are first and second cam blocks slidingly movable both into and out of said closure, each of said cam blocks having a beveled surface that wedgingly engages a surface in the bolt portion of its respective shear key means to apply a closing and an opening force thereto.

31. A latching device as defined in claim 30, wherein the beveled surface of each of said cam blocks is beveled at at angle between 20 and 30 degrees with respect to the direction of movement of said blocks into and out of said closure.

32. A latching device as defined in claim 26, wherein said cam means are formed from Nitronic 60®.

33. A latching device as defined in claim 30, wherein the surfaces in the bolt portion engaged by the cam means are beveled at the same angle as the beveled surfaces of the cam means.

34. A latching device as defined in claim 33, wherein the surfaces in the bolt portion engaged by the cam means define the opposing sides of a slot present in the bolt portion.

35. A latching device as defined in claim 21, wherein each of said drive mechanisms includes a lead screw threadedly engaged to the bolt portion of its respective shear key means for applying an opening and a closing force to said bolt portion when torque is applied to said lead screw.

36. A latching device as defined in claim 35, wherein each of said drive mechanisms includes a drive train for conducting torque to said lead screw.

37. A latching device as defined in claim 36, wherein said drive train includes first and second miter gears, the output of said first gear being coupled to said lead screw, and the input of said second gear including a socket for receiving the shaft of a wrench.

38. A latching device as defined in claim 35, wherein the pitch of the lead screw is between 4 and 6 threads per centimeter.

39. A latching device as defined in claim 37, wherein each of said drive mechanisms further includes bearing plates for supporting said miter gears.

40. A latching device as defined in claim 39, wherein said bearing plates are formed from Nitronic 60®to avoid galling.

* * * * *